United States Patent [19]

Sommer

[11] 4,191,033

[45] Mar. 4, 1980

[54] ROCKER ARM CONSTRUCTION FOR KNITTING MACHINE NEEDLE

[75] Inventor: Werner Sommer, Westhausen, Fed. Rep. of Germany

[73] Assignee: Universal Maschinenfabrik Dr. Rudolf Schieber GmbH & Co. KG, Westhausen, Fed. Rep. of Germany

[21] Appl. No.: 938,573

[22] Filed: Aug. 31, 1978

[30] Foreign Application Priority Data

Jan. 3, 1978 [DE] Fed. Rep. of Germany ..... 2800186

[51] Int. Cl.[2] ..... D04B 7/04

[52] U.S. Cl. ..... 66/64; 66/78; 66/121

[58] Field of Search ..... 66/75.2, 75.1, 64, 60, 66/116, 119, 123, 122, 13, 78, 121

[56] References Cited

U.S. PATENT DOCUMENTS

| | | | |
|---|---|---|---|
| 47,852 | 5/1865 | Otis | 66/120 |
| 52,256 | 1/1866 | Armour | 66/121 |
| 152,466 | 6/1974 | Curtiss | 66/13 |
| 1,877,503 | 9/1932 | Gagne | 66/123 X |
| 4,043,153 | 8/1977 | Lindner | 66/120 X |

*Primary Examiner*—Ronald Feldbaum

*Attorney, Agent, or Firm*—Sughrue, Rothwell, Mion, Zinn and Macpeak

[57] ABSTRACT

A rocker arm 5 is pivotably mounted in a needle shank 15 and biased towards an open position of the needle hook 6 by a spring 17. Upstanding feet 10, 12 on respective lever arms 13, 14 of the rocker arm implement the positive and accurately controlled opening and closing of the needle hook by lock elements 9, 11 slidable along the needle bed.

13 Claims, 9 Drawing Figures

ROCKER ARM CONSTRUCTION FOR KNITTING MACHINE NEEDLE

The invention relates to machines for the manufacture of meshed fabric, in particular knitting machines, in which there may be provided a needle shank, a needle hook and a closure element pivotally connected to the needle shank and controllable for the opening and closing of the needle hook, and a lock for actuating such needles.

In machines for the manufacture of meshed fabric, such as knitting and hosiery machines, predominantly three types of needles are used, namely latch needles, point needles and slide or tubular needles. In machines with continuous operation of individual needles one after another latch needles are often used, while the point and slide needles are used essentially in machines with needles fixedly supported in bars.

In the latch needle which is employed both in knitting and hosiery machines, the preceding stitch controls the latch movement. The latch must have a definite minimum length and the theoretical minimum operational throw of the needle is at least twice the latch length. The stitch is repeatedly opened out during the knitting and can be distorted thereby. Furthermore the stitch must accommodate itself for a given time to the sliding on the ascent ramp which has to be taken into consideration in the formation of the needle track in the form of greater throw as well as, in a given case, of a short needle stoppage. With this, the speed of knitting is again limited.

The supporting of the latch must be, on the one hand, easy motion and, on the other hand, so stable that the loads occurring as a result of the rebound of the latch from the point of the needle hook during retraction of the needle and the rebound in the other end position during insertion of the needle are satisfactorily absorbed.

Further disadvantages of latch needles consist in that provision must be made for opening the needle latches during increase or take-up of stitches on knitting machines by additional means, for example by magnets or by opener threads. Also, the latch needle has the disadvantage that individual fibres of the individual thread can be damaged by shearing by the latch closure in the retraction position.

Furthermore, in latch needles, the masses of the needle hook and the needle chest arranged eccentrically with respect of the needle axis act unfavourably, whereby the eccentric mass of the hook is function defined and the mass of the needle chest is nevertheless a specific characteristic of the latch needle. Strong stress peaks arise with the occurrence of function defined bending oscillations which can lead to the breaking of the needle in the region of the hook since the needle cannot be formed elastically enough.

Finally, the movement of the latch needle in its needle channel through the necessarily long stroke of the latch needle, particularly in high load circular knitting machines with high system count and high rotation count, leads to the occurence of high friction temperatures which lead to lubrication and tolerance problems.

Point (beard) needles are predominantly used in hosiery machines. In order to be able to close the hook using an additional controlled element, the hook must be very elastic so that a relatively long and slender hook point results. The hook point defines the throw which is yet longer than with latch needles. Accordingly point needles are not suitable for higher speeds. Further, there is the danger that the hook point fails to open fully after a lengthy running time so that, on the introduction of a fibrous yarn, the introduced thread is pierced during the retraction cycle. Finally, on closure of the needle by the presser, the threads or individual fibres can become separated.

Slide needles or compound needles are used in knitting and hosiery machines. The total height of the needles is defined through the height of the slider opening and closing the needle, the depth of the slide groove in which the slider slides as well as the thickness of the groove base of the needle. Each change in dimension of the hook height results in a change of the total height of the needle. Without changes to the lock or needle bed it is not possible to introduce sliding needles of different hook size for one and the same fineness.

In order to ensure certain closure of the needle hook with small closure loads, needle and slider must be controlled very exactly. Also during take-up and increase a very exact control is necessary. Since needle and slider must be controlled the needle length of the slide needle is larger that that of the corresponding latch needle.

The thermal stresses with slide needles are approximately as big as those with latch needles since not only the needle slides in the needle channel but also the slider rubs in the groove in the needle shank. Finally the inset sliders must be held down through additional lock elements or cover pieces in order to prevent the inset sliders falling out.

Finally, in respect of tubular needles problems occur which are similar to those with slide needles. The difference with respect to the slide needle consists in particular in the needle shank which is built as a tube which receives the closure wire. The point of the closure wire must be fully enclosed in the tube during opening of the needle.

From German Patent Specification No. 1 269 283 it has become known to use a pivotable needle hook instead of a latch to reduce the needle stroke. A pin through the shank serves as a pivot point while control can be exercised by way of the lever lying opposite to the needle. Since the needle hook must be as long as with a point needle the needle path during stitch formation is longer than with the formation with fixed hooks.

From German Patent Specification No. 1 217 540 a needle with a needle hook is known which is sprung like a point needle but is closed in its unstressed position. The opening of the needle hook results by way of a lever or double lever supported on a pin in the needle shank, which lever is controlled through bevels fixed relative to the needle or to the cylinder. The needle stroke for such needles is at least as large as with known point needles.

Further from the German Patent Specification No. 24 21 055 a needle having a needle shank provided with a needle hook is known which includes a closure element pivotably connected to the needle shank controllable for the opening and closing of the needle hook. In this needle the closure element is so constructed that it can disappear in the needle shank and then appear out of this with a cam behind. The needle hook is closed by pressure on the cam from a passing control element, whereby the forwardly split closure element grips the point of the needle hook. The stitch can be broken by too high a lifting of the closure element.

Finally from the U.S. Pat. No. 2,441,662 there is known a needle arrangement for machines for the manufacture of meshed fabric having a needle shank provided with a needle hook, a rocker arm pivotably supported on the needle shank beyond the thread zone, controllable for the opening and closing of the needle hook and a spring element for holding the rocker arm in a position opening the needle hook, and a projection being provided on a lever arm of the rocker arm for a closing operation of the rocker arm by means of a control element. The rocker arm of this needle is supported in a groove of the needle shank and is operated by a control element being moved in a direction perpendicular to the axis of the needle and pressing on the extension for a closing operation of the lever arm.

All the described and known closure elements are supported by means of a pin in a slit or groove of the needle shank. For an actuation of the closure element from the underside of the needle shank, this must be slit through to the underside. The slitting of the needle shank leads to such a weakening that neither the closure element nor the needle shank is able to cope with the load occurring during an actuation of the closure element by means of a passing lock element.

In accordance with the present invention there is provided a needle arrangement for machines for the manufacture of meshed fabric having a needle shank provided with a needle hook, a rocker arm pivotably supported on the needle shank beyond the thread zone, controllable for the opening and closing of the neddle hook, and a spring element for holding the rocker arm in a position opening the needle hook, and a projection being provided on a lever arm of the rocker arm for a closing operation of the rocker arm by means of a control element, wherein the projection of the lever arm of the rocker arm is a foot operated by means of a lock element, a further foot is provided on each lever arm of the rocker arm for the opening operation of the rocker arm by means of a further lock element, and the rocker arm is constructed as wide as the needle shank and is held against sideways movement by the side walls of a needle receiving channel.

A needle constructed in accordance with the invention may render possible an increase in the knitting speed and lead to a greater functional certainty in the machine since the closure movement of the rocker arm by way of a lock element is effectively controlled and the needle is in less danger of breaking in the thread zone than known needles for stitch making. As a result of the effective control of the closure element by lock elements the closure of the needle is also no longer dependent on the needle stroke so that this can be reduced with respect to known needles and correspondingly the heat development by the movement of the needle in the needle channel is reduced.

By means of the foot the opening operation of the rocker arm by means of a further lock element the rocker arm is not only effectively controlled during the closing but also during the opening thereof whereby the opening and the closing movement of the rocker arm can be adjusted accurately to the stitch building cycle and the needle hook is always opened with very high functional certainty during take-up and increase. A crushing of fibres, as is, for example, possible with known latch needles, can no longer occur. The contruction of the rocker arm as wide as the needle shank a robust needle being stabilised during operation is achieved.

When, then, rocker arms and needle channels are so constructed that the rocker arm lies fully in the needle channel even in the extreme position, then it is assured that the rocker arm can move unhindered and trouble free in the opening and closing of the hook.

With the needle according to the invention a decidedly smaller needle stroke is necessary for stitch construction as compared with known latch needles. Since, furthermore, the needle movement for capture and stitch has to show no difference, an optimal control of the needle is realisable with the object of a constant and uninterrupted acceleration of the needle which leads to a higher knitting speed.

The lever arm of the rocker arm adjacent to the needle hook is preferably made resistant to bending.

Further it is advantageous for the lever arm of the rocker arm adjacent to the needle hook to be constructed so that its surface runs essentially parallel to the back of the needle in the thread zone in the closed state of the needle hook. In this way it happens that the previous stitch is not additionally opened up by sliding over the parallel surface and thereby the sliding occurs particularly easily. The opening up of the previous stitch which is necessary in the needle art for pulling the needle hook through, has previously been obtained through the rocker arm itself in closure of the needle hook. The clearing of the needle is efficient which is particularly advantageous at higher knitting speeds.

The parallel surface of the lever arm in the thread zone is usefully limited with respect to the pivot point of the rocker arm through an upstanding shoulder. The shoulder limits the sliding of a stitch over the parallel surface beyond the pivot point of the rocker arm. If at the end of the lever arm adjacent to the needle hook a depression is provided in which the point of the needle hook can come to lie, the stitch can slide unhindered over the needle hook in the closed condition of the needle hook. The spring element holding the rocker arm in the normal open position is usefully a spring seated on the lever arm remote from the needle hook and extending to the needle shank. The spring can be constructed integrally with the needle shank.

The link between needle shaft and rocker arm can be a pivoting link with pivot head on the rocker arm or a spring link. Both links have the advantage that they have an easy action and that the needle shaft is only insignificantly weakened. The feet on the lever arms of the rocker arm are usefully so arranged that they still extend somewhat out of the needle bed in the pushed down or closed needle position. Thereby, it is assured that the lock elements operating the feet can hold these under spring pressure without the danger arising of a rubbing of the lock elements on the surface of the needle bed.

According to the invention also there is provided a lock for a knitting machine equipped with a needle arrangement according to the invention and as defined above, wherein at least one lock element is provided for the operation of a respective foot on a lever arm of the rocker arm, of which element the surface acting on said foot has a constant spacing from the upper edge of a needle channel and a dimension in the direction of the direction of movement of the needles in the needle channels is greater than the maximum needle throw.

With such a lock the rocker arms are able always to hold exactly the correct position independently of the working position of the needle during the working of the needle.

Advantageously several lock elements are arranged one behind another along the relative direction of movement between the lock elements and the feet.

A development of the lock according to the invention consists in that at least some of the lock elements are controllable into working positions and out of working positions.

Further the lock elements, at least in the case when they do not follow one another immediately, usefully have entry and exit ramps.

In accordance with a further aspect of the invention there is provided a lock arrangement for a V-bed knitting machine having locks as defined above wherein a plurality of the lock elements are arranged symmetrically with respect to the longitudinal central axis of the knitting machine over the forward and rearward needle bed. Further, the lock elements can thereby be arranged symmetrically with respect to the transverse central axis of the lock. In this way the same working possibilities for the knitting machine in both running directions of the lock are obtained.

In the knitting of patterns with very long free lying yarns on a machine which incorporates needles and locks according to the invention, these yarns can lie behind the rocker arms in the normal position and thus be securely separated from the knitting process. Furthermore, the lock elements which are controllable into and out of the working position can be set up for the movement of the rocker arms in such a way that the newly introduced yarn comes to lie between the lever arm adjacent to the needle hook and the upper needle shank.

Explanatory embodiments of the invention are illustrated in the drawings and will be further described below. In the drawings.

Figure 1:
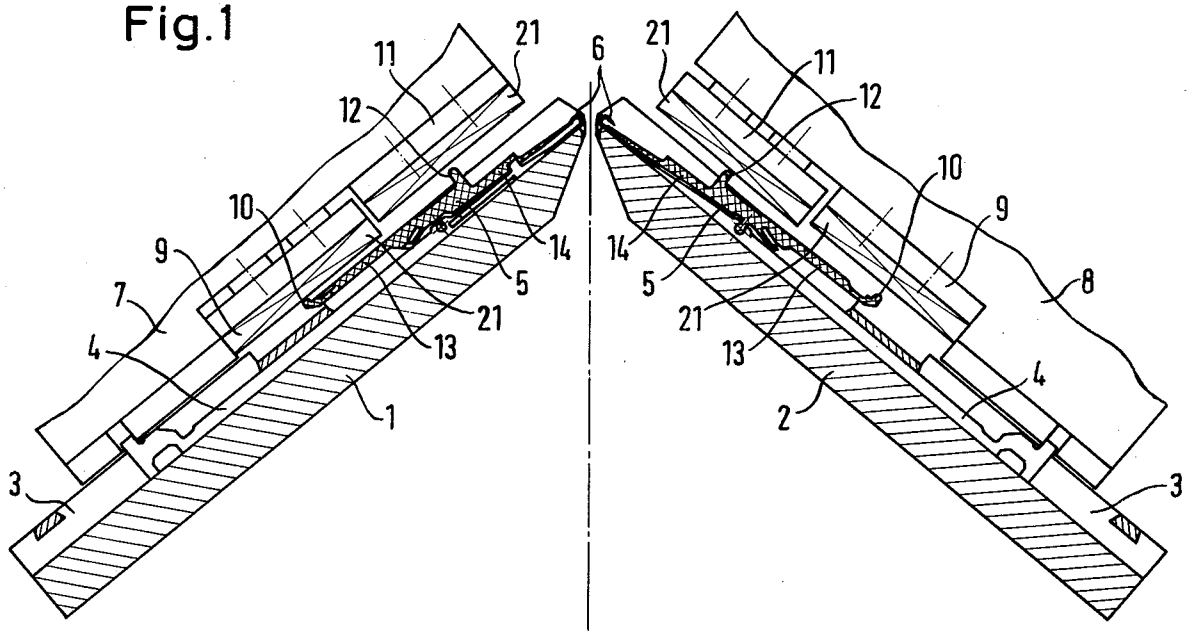
FIG. 1 is a cross section through the needle bed of a V-bed knitting machine constructed in accordance with aspects of the invention.

In the embodiment of the invention shown in the drawings FIG. 1 is a cross section through a forward needle bed 1 and a rear needle bed 2 of a V-bed knitting machine. In a needle channel 3 of the needle bed 1 is a needle 4 with a rocker arm 5 arranged so that the needle hook 6 of the needle is closed. The needle hook 6 of the needle 4 having rocker arm 5 in the needle channel 3 of the needle bed 2 is open.

Slidable locks 7 and 8 with a slide (not shown) are provided along and over the needle beds 1 and 2. The locks have lock elements (not further described) for the insertion and retraction of the needles 4 by way of feet on the rear ends of the needles. Furthermore controllable lock elements 9 for the controlled downward pressing of feet 10 and lock elements 11 for the downward pressing of feet 12 perpendicular to the needle bed surfaces are provided. The feet 10 are located respectively on lever arms 13 of rocker arms 5 remote from the needle hooks 6 and the feet 12 are located respectively on lever arms 14 of rocker arms 5 adjacent to the needle hooks 6. The feet 10 and 12 extend upwardly out of the channels in the needle beds 1 or 2. Even in the actuated condition the feet 10 and 12 still extend above the surfaces of the needle beds while they are in contact with the actuated lock element 9 or 11.

Figure 2:
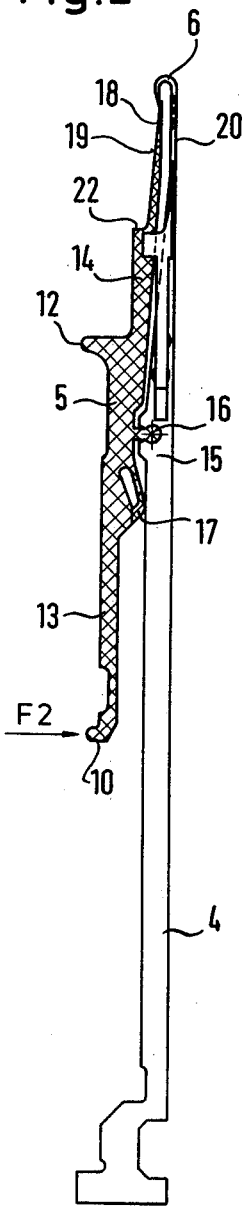
FIG. 2 is a side view of a needle according to the invention with a closed needle hook.
Figure 3:
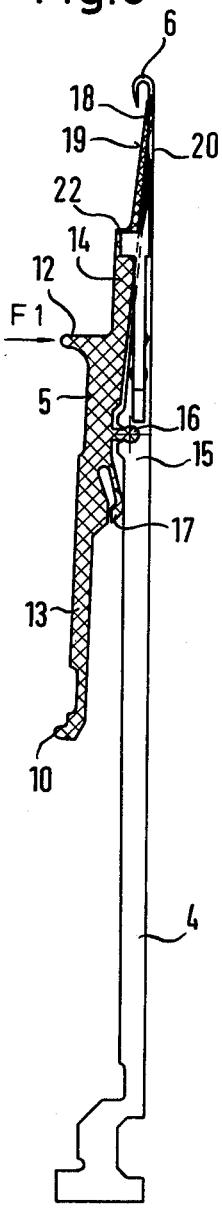
FIG. 3 is a side view of the needle according to FIG. 1 with an open hook.

In FIGS. 2 and 3 a needle 4 with respectively closed or opened needle hook 6 is shown. The rocker arm 5 is pivotably fixed by means of a pivoting link on a needle shank 15. A pivot head 16 formed on the rocker arm 5 sits in a corresponding recess of the needle shank 15. On the underside of the lever arm 13 of the rocker arm 5 there is a spring element 17 in the form of a spring formed integrally with the rocker arm 5. The spring element 17 acts so that the rear lever arm 13 of the rocker arm 5 is pushed high with respect to the shank 15 of the needle 4 and so that the forward end 18 of the forward lever arm 14 of the rocker arm 5 is pushed down and the needle hook 6 opens (FIG. 3). A depression is formed at the end 18 of the lever arm 14 of the rocker arm 5 in which the point of the needle hook 6 comes to lie in the closed state of the needle hook 6 (FIG. 2).

In the operative situation selected lock elements 9 slide positively over the feet 10 of the rocker arm 5 and press with a load F2 on these feet in order to close the needle hook 6 resiliently with the forward end of the lever arm 14 of the rocker arm 5. When lock elements 11 are selected in the operative situation these glide over the feet 12 of the rocker arm 5 and press the forward end 18 of the lever arm 14 of the rocker arm 5 with a load F1 resiliently against the needle shank 15 so that the needle hook 6 is opened.

The lever arm 14 of the rocker arm closest to the needle hook 6 is built so that its surface 19 runs essentially parallel to the back of the needle 20 in the thread zone when the needle hook 16 (FIG. 2) is closed. As a result of this parallelism the stitch can slide without additional opening up over the surface 19 and over the needle head 6 if this is closed.

Figure 4:
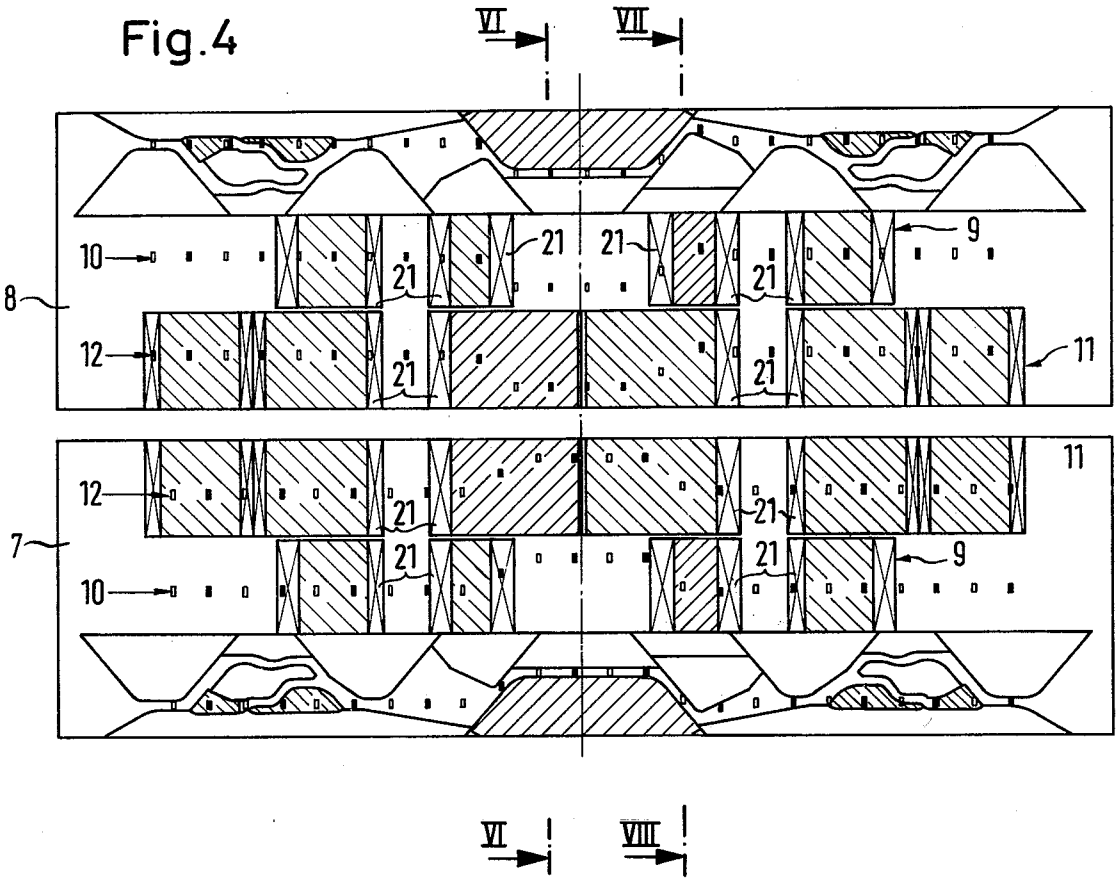
FIG. 4 is an under view of the locks for a V-bed knitting machine according to FIG. 1 with, for a better representation, lock plates brought into one plane and with such lock elements engaged that all the needles make stitches during a slide movement from right to left.

FIG. 4 shows an underview of a lock arrangement for the V-bed knitting machine of FIG. 1 viewed respectively perpendicularly from below on the forward lock 7 and the rearward lock 8. Respective pluralities of selectable lock elements 9 are arranged in one row and lock elements 11 are arranged in another row along the direction of movement of the slide (not illustrated). The respective position of the feet 10 and 12 of the rocker arm 5 in the longitudinal direction of the needle 4 and rocker arm 5 are similarly defined. The lock elements 9 and 11 used in the operative situation for pressing down the feet 10 and 12 are shaded from upper right to lower left while the corresponding lock elements 9 and 11 used in the operative situation are shaded from upper left to lower right.

Figure 5:
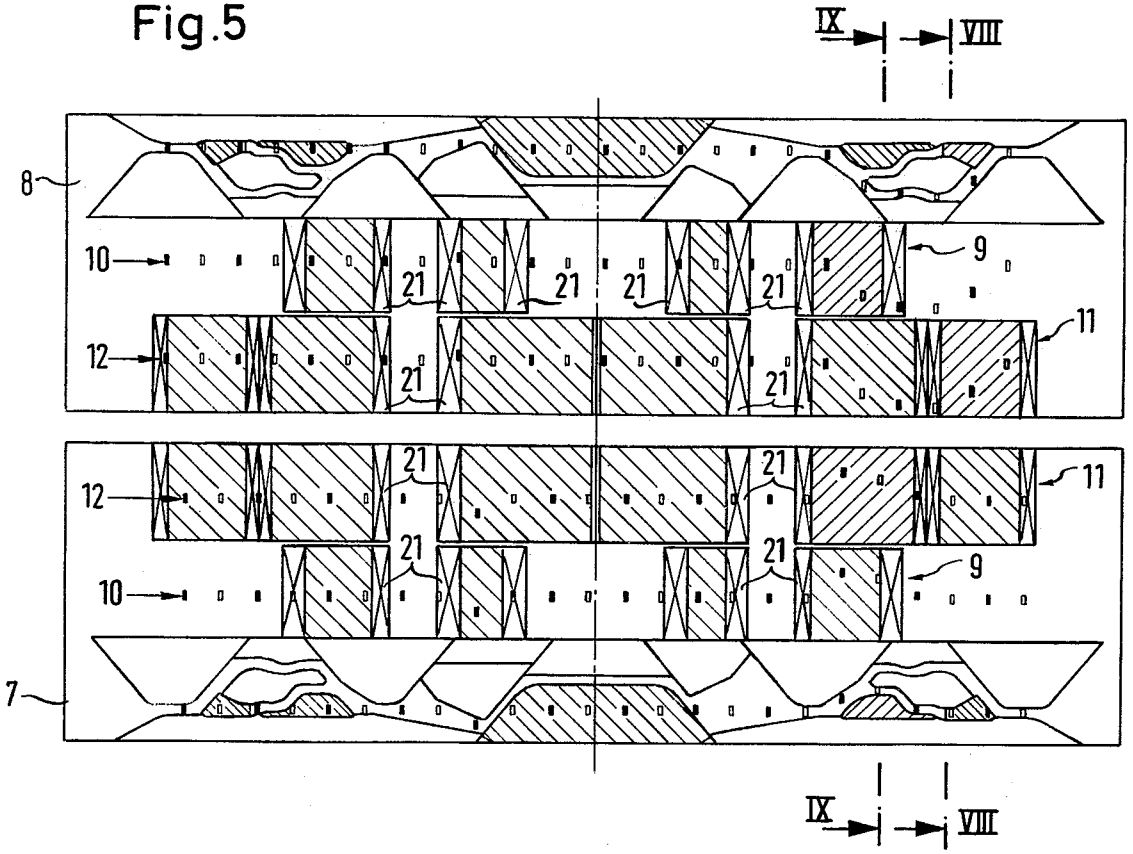
FIG. 5 is a view similar to that of FIG. 4 with such lock elements engaged that all needles take-up from front to back during movement of the slide to the right.
Figure 6:
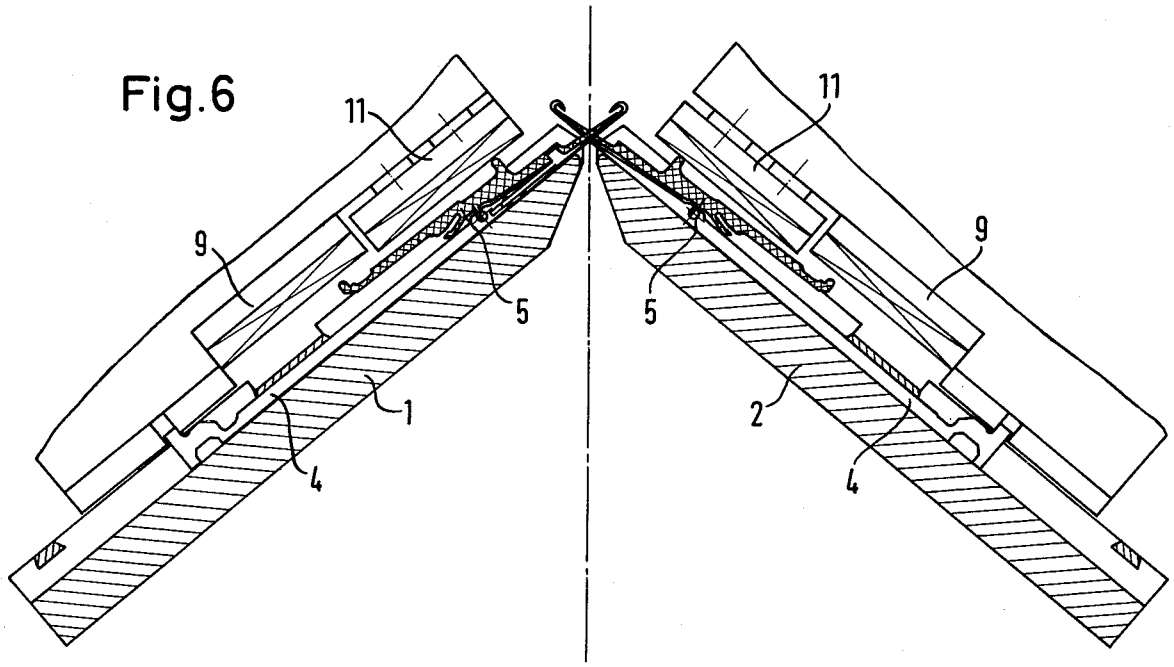
FIG. 6 is a cross section through the needle bed of the V-bed knitting machine along line VI—VI in FIG. 4.
Figure 7:
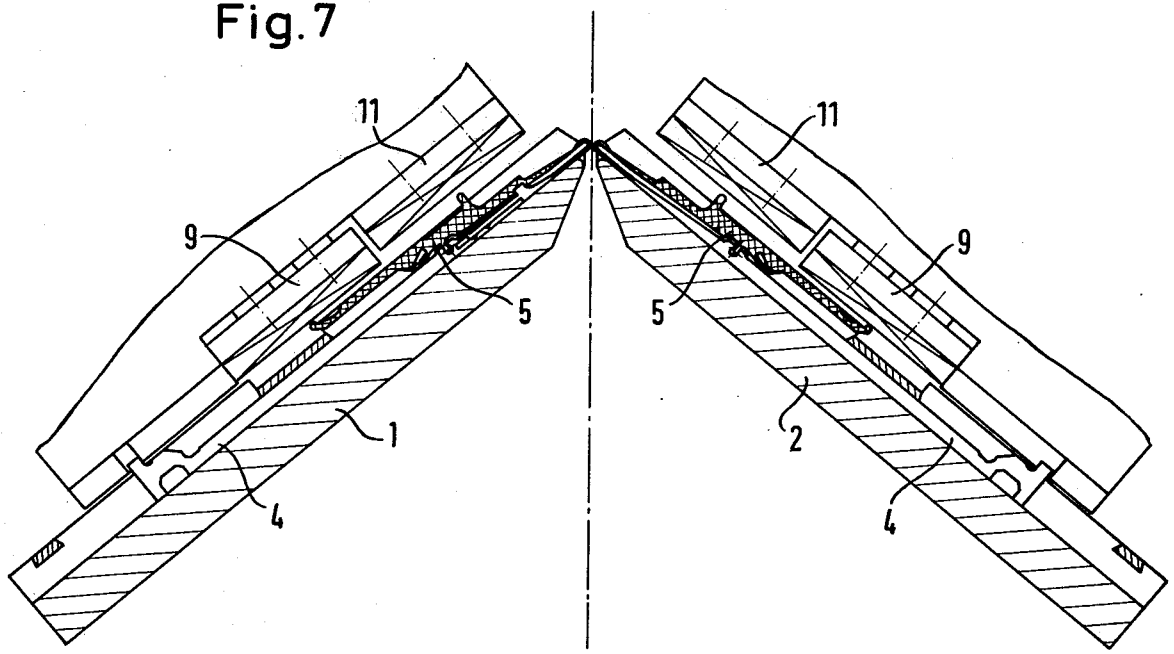
FIG. 7 is a cross section as in FIG. 6 along line VII—VII in FIG. 4.
Figure 8:
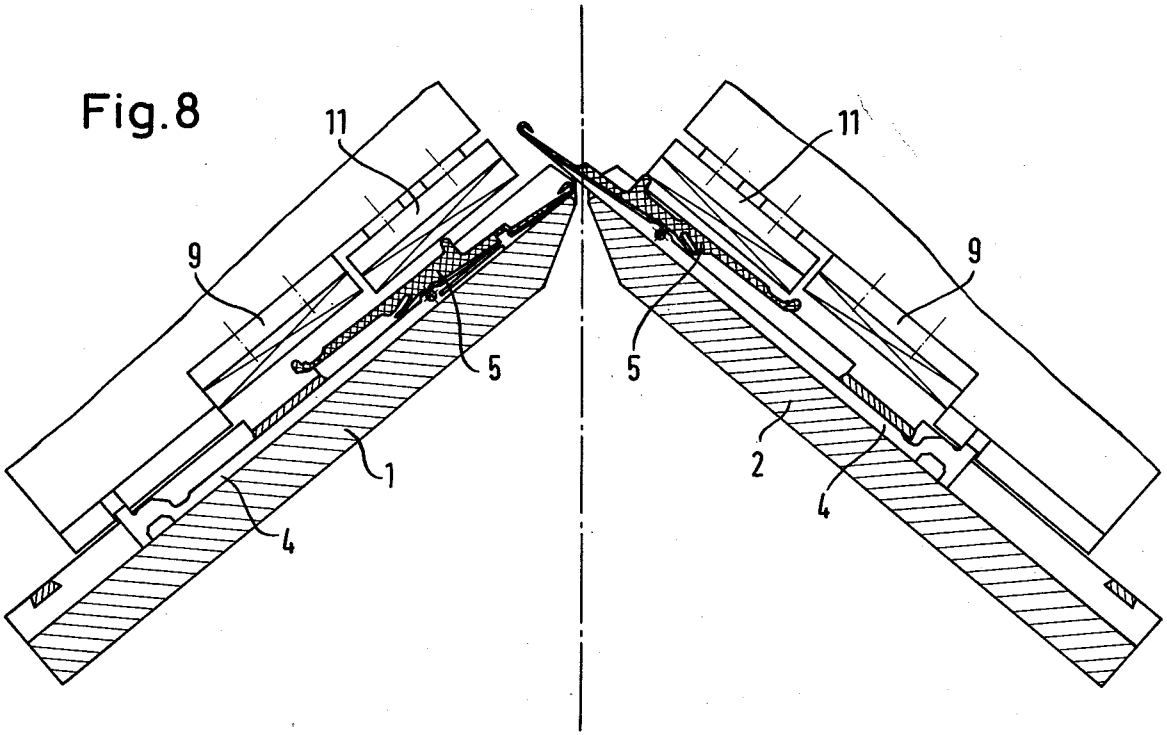
FIG. 8 is a cross section as in FIG. 6 along line VIII—VIII in FIG. 5.
Figure 9:
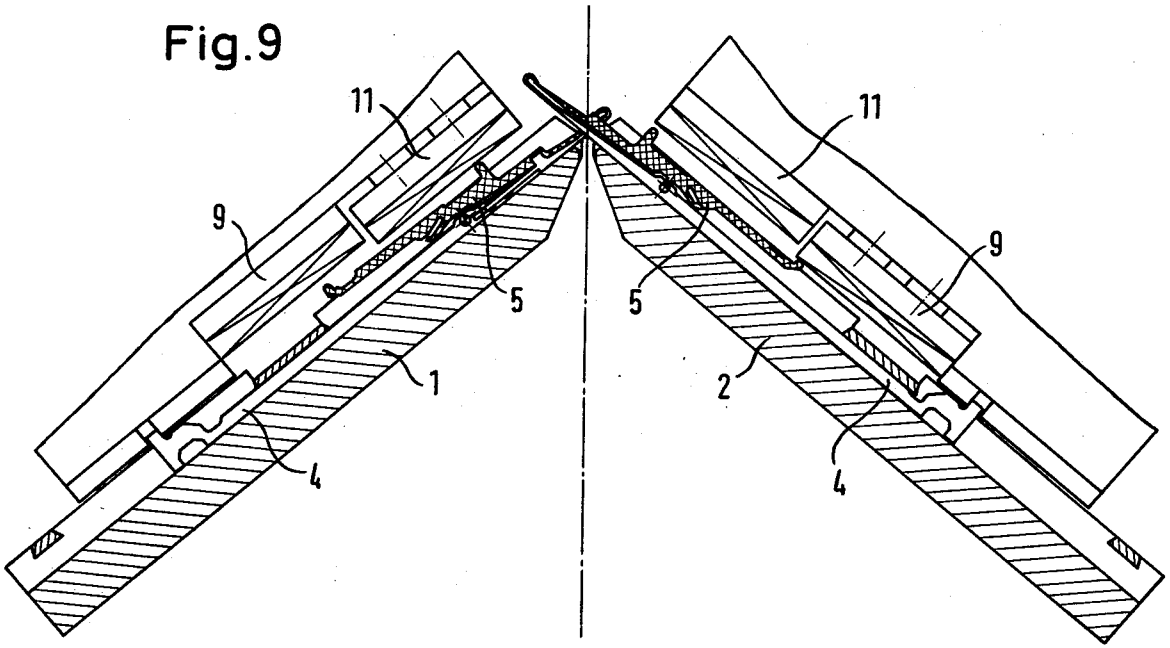
FIG. 9 is a cross section as in FIG. 6 along line IX—IX in FIG. 5.

FIG. 4 shows a selection of the lock elements 9 and 11, as well as a positioning of the feet 10 and 12 of the rocker arm 5, as is required in a movement of the slide from right to left when all needles build stitches. FIG. 5 shows the same lock arrangement for the case that the slide moves from left to right and take-up is from the rearward needle bed 2 onto the forward needle bed 1.

FIGS. 6, 7, 8 and 9 show cross sections through the needle beds of the V-bed knitting machine along the lines VI—VI, VII—VII, VIII—VIII, and IX—IX, in FIGS. 4 and 5. The positions of the needles 4, of the lock elements 9 and 11 as well as of the feet 10 and 12 of the rocker arm 5 are clearly recognisable in these Figures.

The lock elements 9 and 11 have entry and exit ramps 21 and are arranged symmetrically to the longitudinal centre axis of the machine and symmetrically to the transverse central axis of the locks in the illustrated lock arrangement.

With regard to the lever arm 14 of the rocker arm 5 adjacent to the needle hook 6, a shoulder 22 on the inner end of the surface 19 of the lever arm 14 prevents a stitch sliding over the surface 19 being able to slide back further than the pivot point of the rocker arm 5.

The operation of the needle 4 with a rocker arm 5 as described is as follows. By virtue of the action of the resilient element 17 between the rocker arm 5 and the needle shank 15 the lever arm 14 of the rocker arm 5 adjacent to the needle hook 6 becomes so pressed down against the needle shank 15 in the normal position that the needle hook 6 is opened and threads can slide in the open needle hook 6. On the forward pass of a lock element 9 selected in the operative situation over the foot 10 of the rocker arm 5, the lever arm 13 of the rocker arm 5 spaced from the needle hook 6 is pressed down and held pressed down independently of the longitudinal movement of the needle since the dimension of the closure elements 9 in the direction of movement of the needle is larger than the largest possible needle stroke. Therefore, the needle head 6 stays precisely and controlledly closed for as long as this is necessary for the knitting or active cycle through the positive contact between the lock element 9 and the foot 10 of the rocker arm 5.

After passage of the lock element 9 the foot 10 of the rocker arm 5 is again released and the rocker arm 10 is brought into the normal position with the open needle hook 6 under the action of the spring element 17. In order to increase the security of functioning of the needle 4 still further, lock elements 11 are provided which on selection in the working position press on the feet 12 and give an exactly controlled opening of the needle hook by their shape. The lock elements 9 and 11 are constructed and arranged or controllable in accordance with the opening and closing requirements of the needle hooks in the different steps of the stitch formation and the take-up.

With the needle 4 provided with rocker arm 5 an exactly defined selection of the closure element of the needle constructed as a balanced element possibly suited according to requirements and for the stitch formation cycle becomes possible. The needle stroke is independent of the control cycle during the closing and opening of the needle hook 6 so that the needle strokes for capture and stitch can be made of equal size and kept small.

What we claim is:

1. A needle arrangement for machines for the manufacture of meshed fabric, including a needle shank provided with a needle hook, a rocker arm pivotably supported on the needle shank beyond a thread zone and controllable to open and close the needle hook, a spring element for biasing the rocker arm towards a position whereat the needle hook is open, and a projection on a first lever arm of the rocker arm remote from the needle hook for implementing the closing of the needle hook by means of a control element, characterized by: the projection on the first lever arm comprising a foot operated by a first lock element movable along a needle bed, a further foot on a second lever arm of the rocker arm proximate the needle hook for implementing the opening of the needle hook by means of a second lock element movable along the needle bed, and the rocker arm being constructed as wide as the needle shank and being held against lateral movement by side walls of a needle receiving channel.

2. A needle arrangement according to claim 1, wherein the second lever arm is constructed to be resistant to bending.

3. A needle arrangement according to claims 1 or 2, wherein the second lever arm is so constructed that its upper surface runs essentially parallel to the back of the needle in the thread zone when the needle hook is closed.

4. A needle arrangement according to claim 3, wherein the parallel upper lever arm in the thread zone is delimited with reference to the pivot point of the rocker arm by an upstanding shoulder.

5. A needle arrangement according to claim 1, wherein the pivotable support between the needle shank and the rocker arm is a hinge joint including a hinge head on the rocker arm.

6. A needle arrangement according to claim 1, wherein the pivotable support between the needle shank and rocker arm is a spring link.

7. A needle arrangement according to claim 1, wherein the feet on the lever arms of the rocker arm extend, in the closed needle hook position, above the upper surface of the needle bed.

8. A lock for a knitting machine equipped with needles according to claim 1, wherein at least one lock element is provided for the operation of a respective foot on a lever arm of the rocker arm, of which element the surface acting on said foot has a constant spacing from the upper edge of a needle channel and a dimension in the direction of movement of the needles in the needle channels which is greater than the maximum needle throw.

9. A lock according to claim 8, wherein several lock elements are arranged one behind the other in the direction of relative movement between the lock elements and the feet.

10. A lock according to claim 8, wherein at least some of the lock elements are selectable in a working position or in a non-working position.

11. A lock according to claim 8, wherein the lock elements include approach and exit ramps.

12. A lock arrangement having locks according to claim 8 for a V-bed knitting machine, characterised in that a plurality of the lock elements are arranged symmetrically with respect to the longitudinal central axis of the knitting machine over the front and rear needle beds.

13. A lock arrangement according to claim 12, wherein the lock elements are arranged symmetrically with respect to the transverse central axis of the lock.

* * * * *